US010125521B2

(12) United States Patent
Ciecha

(10) Patent No.: US 10,125,521 B2
(45) Date of Patent: Nov. 13, 2018

(54) MAGNETIC LOCK SYSTEM

(71) Applicant: LES INDUSTRIES CAPITOL INC., Montreal (CA)

(72) Inventor: Hernan Ciecha, Hampstead (CA)

(73) Assignee: LES INDUSTRIES CAPITOL INC., Montreal (CA)

( * ) Notice: Subject to any disclaimer, the term of this patent is extended or adjusted under 35 U.S.C. 154(b) by 265 days.

(21) Appl. No.: 15/087,113

(22) Filed: Mar. 31, 2016

(65) Prior Publication Data

US 2016/0290010 A1 Oct. 6, 2016

Related U.S. Application Data

(60) Provisional application No. 62/142,276, filed on Apr. 2, 2015.

(51) Int. Cl.
*E05B 47/00* (2006.01)
*E05C 3/04* (2006.01)

(52) U.S. Cl.
CPC ..... *E05B 47/0045* (2013.01); *E05B 47/0044* (2013.01); *E05C 3/042* (2013.01)

(58) Field of Classification Search
CPC .... E05B 47/00; E05B 47/004; E05B 47/0042; E05B 47/0044; E05B 47/0045; E05B 37/12; E05B 17/145; E05B 17/186; E05C 3/042
USPC ..... 70/276, 413, 416, 417, 365, 423
See application file for complete search history.

(56) References Cited

U.S. PATENT DOCUMENTS 3,633,393 A * 1/1972 Hisatsune ..... E05B 47/0042 70/25
3,657,907 A * 4/1972 Boving ..... E05B 47/0041 70/276
3,782,147 A * 1/1974 Hallmann ..... E05B 47/0042 70/276
3,837,195 A * 9/1974 Pelto ..... E05B 47/0038 70/276
3,948,068 A * 4/1976 Stackhouse ..... E05B 47/0041 70/276
3,967,479 A * 7/1976 Vick ..... E05B 47/0041 200/43.08
4,022,038 A * 5/1977 Miller ..... E05B 47/0038 70/276
4,061,004 A * 12/1977 Pappanikolaou ... E05B 27/0032 70/276

(Continued)

*Primary Examiner* — Suzanne L Barrett
(74) *Attorney, Agent, or Firm* — McDonnell Boehnen Hulbert & Berghoff LLP

(57) ABSTRACT

A lock device comprising: a lock frame defining a cavity and having at least one frame recess; a lock body having a key-receiving face and defining a chamber and the longitudinal wall comprising at least one aperture therethrough emerging in the chamber, each one of the at least one aperture facing a respective one of the at least one frame recess, the lock body being moveable within the cavity of the lock frame; a translation pin movably inserted within the chamber; an active pin positioned within an aperture of the lock body and movable between an insertion position and a retracted position; a moveable magnetic body positioned within the chamber to sequentially prevent and allow motion of the translation pin; and an actuator body movable between a locked position and an unlocked position.

17 Claims, 8 Drawing Sheets

(56) References Cited

U.S. PATENT DOCUMENTS

| | | | | |
|---|---|---|---|---|
| 4,285,220 | A * | 8/1981 | Kajita | E05B 47/0041 70/276 |
| 4,290,285 | A | 9/1981 | Bela et al. | |
| 4,333,327 | A * | 6/1982 | Wake | E05B 47/0042 70/276 |
| 4,841,758 | A * | 6/1989 | Ramblier | E05B 47/0044 70/276 |
| 6,386,006 | B1 * | 5/2002 | DeWalch | E05B 19/00 70/34 |
| 8,800,332 | B2 | 8/2014 | Oliana | |
| 8,863,563 | B2 * | 10/2014 | Gentile | E05B 47/0038 24/303 |
| 9,010,161 | B2 | 4/2015 | Oliana | |
| 9,273,494 | B2 * | 3/2016 | Fontana | E05B 47/0038 |
| 2012/0131967 | A1 * | 5/2012 | Sanchez Giraldez | A41F 1/002 70/276 |
| 2012/0210757 | A1 * | 8/2012 | Gentile | E05B 67/365 70/276 |
| 2012/0291501 | A1 * | 11/2012 | Gentile | E05B 47/0038 70/276 |
| 2014/0230500 | A1 * | 8/2014 | Oliana | E05B 15/14 70/344 |

* cited by examiner

MAGNETIC LOCK SYSTEM

CROSS REFERENCE TO RELATED APPLICATIONS

The present application claims priority to U.S. Provisional Patent Application No. 62/142,276, filed Apr. 2, 2015, which is incorporated by reference into the present application.

TECHNICAL FIELD

The present invention relates to the field of lock devices, and more particularly to magnetic lock devices.

BACKGROUND

Usually, cylinder locks require the use of a bitted key adapted to push pins when the key is inserted within the cylinder in order to line the pins up to a shear line and allow the core of the cylinder to rotate freely. Such cylinder locks may be vulnerable to many forms of vandalism, attacks, and/or lock picking, such as the insertion of glue or other contaminants, or the use of lock picking tools to determine when the pins are in an unlocked position.

In order to overcome the vulnerability of such cylinder locks, a protective device may be used. For example, such a magnetic protective device may comprise a sliding plate to cover the cylinder lock completely and a magnetic key to unlock the protective cover. However, such a protective device requires the user to carry the magnetic key for locking/unlocking the protective device and accessing the cylinder lock in addition to the key for locking/unlocking the cylinder lock.

Therefore, there is a need for an improved lock system.

SUMMARY

In accordance with a first broad aspect, there is provided a lock device comprising: a lock frame extending along a longitudinal axis, defining a cavity, and having at least one frame recess on an internal wall thereof; a lock body having a longitudinal wall extending along the longitudinal axis and a key-receiving face, the lock body defining a chamber and the longitudinal wall comprising at least one aperture therethrough, each one of the at least one aperture facing a respective one of the at least one frame recess, the lock body being moveable within the cavity of the lock frame between a first body position and an second body position; a translation pin movably inserted within the chamber; at least one active pin each positioned within a respective aperture of the lock body and movable between an insertion position in which the active pin abuts against a respective frame recess of the lock frame and prevent the lock body from moving within the cavity, and a retracted position in which the active pin is away from the frame recess and allows the lock body to move within the cavity; at least one magnetic body each positioned within the chamber of the lock body and movable between a first pin position in which the translation pin is prevented from moving and a second pin position in which the translation pin is allowed to move; and an actuator body secured to the lock body to move from a locked position when the lock body is in the first body position and an unlocked position when the lock body is in the second body position, wherein upon positioning a magnetic key adjacent to the key-receiving face, the at least one magnetic body moves from the first pin position to the second pin position to allow the translation pin to move within the chamber and upon rotating the magnetic key, the active pins move from the insertion position to the retracted position, thereby allowing the lock body to move from the first body position to the second body position and the actuator to move from the locked position to the unlocked position.

In one embodiment, the lock body is slidable within the lock frame.

In another embodiment, the lock body is rotatable within the lock frame.

In one embodiment, the lock frame and the lock body each have a cylindrical shape.

In one embodiment, the at least one frame recess each have a semi-cylindrical shape.

In one embodiment, the at least one magnetic body are each rotatably secured to the lock body, the first and second body positions corresponding to a first angular position and a second angular position, respectively.

In one embodiment, the at least one magnetic body each comprise a non-magnetic cylinder rotatably secured to the lock body and the lock frame.

In one embodiment, the at least one magnetic body comprises a magnet-receiving recess and a magnet secured therein.

In one embodiment, the non-magnetic cylinder comprises two conical ends, a first one of the two conical ends being received in a first conical recess within the lock frame and a second one of the two conical ends being received in a second conical recess within the lock body for rotatably securing the non-magnetic cylinder to the lock body and the lock frame.

In one embodiment, the non-magnetic cylinder comprises a recess on an external face for receiving at least a section of the translation pin thereon.

In one embodiment, the lock device further comprises a thread extending circumferentially along a section of the lock frame.

In one embodiment, the at least one frame recess comprise two frame recesses each corresponding to a respective one of the locked and unlocked positions.

In one embodiment, the at least one active pin are each provided with rounded ends.

In one embodiment, the actuator body comprises a cam.

According to another aspect, there is provided a lock system comprising the lock device and a magnetic key.

In one embodiment, the magnetic key comprises at least one key magnet each positioned within the magnetic key so as to substantially face a respective one of the at least one magnetic body when the magnetic key is positioned adjacent to the key-receiving face.

In one embodiment, the magnetic key and the key-receiving face of the lock body are so that a motion of the magnetic key triggers a motion of the lock body within the lock frame.

BRIEF DESCRIPTION OF THE FIGURES

Further features and advantages of the present invention will become apparent from the following detailed description, taken in combination with the appended drawings, in which.

It will be noted that throughout the appended drawings, like features are identified by like reference numerals.

DETAILED DESCRIPTION

Figure 1:
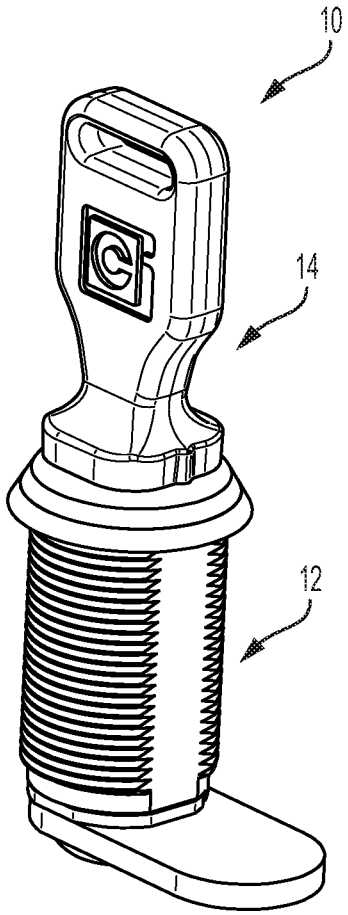
FIG. 1 is a perspective view of a lock system comprising a magnetic cylinder lock and a magnetic key and operating in rotation, in accordance with an embodiment.

FIG. 1 illustrates one embodiment of a magnetic lock system 10 comprising a magnetic lock device or lock 12 and a magnetic key 14 for locking and unlocking the magnetic lock device 12. The lock device 12 is securable to an element or object to be locked/unlocked such as a door, a cabinet, or the like. By abutting the magnetic key 14 on the magnetic lock device 12 and rotating the magnetic key 14 according to a respective rotation direction, the magnetic lock device 12 may be locked or unlocked.

Figure 2:
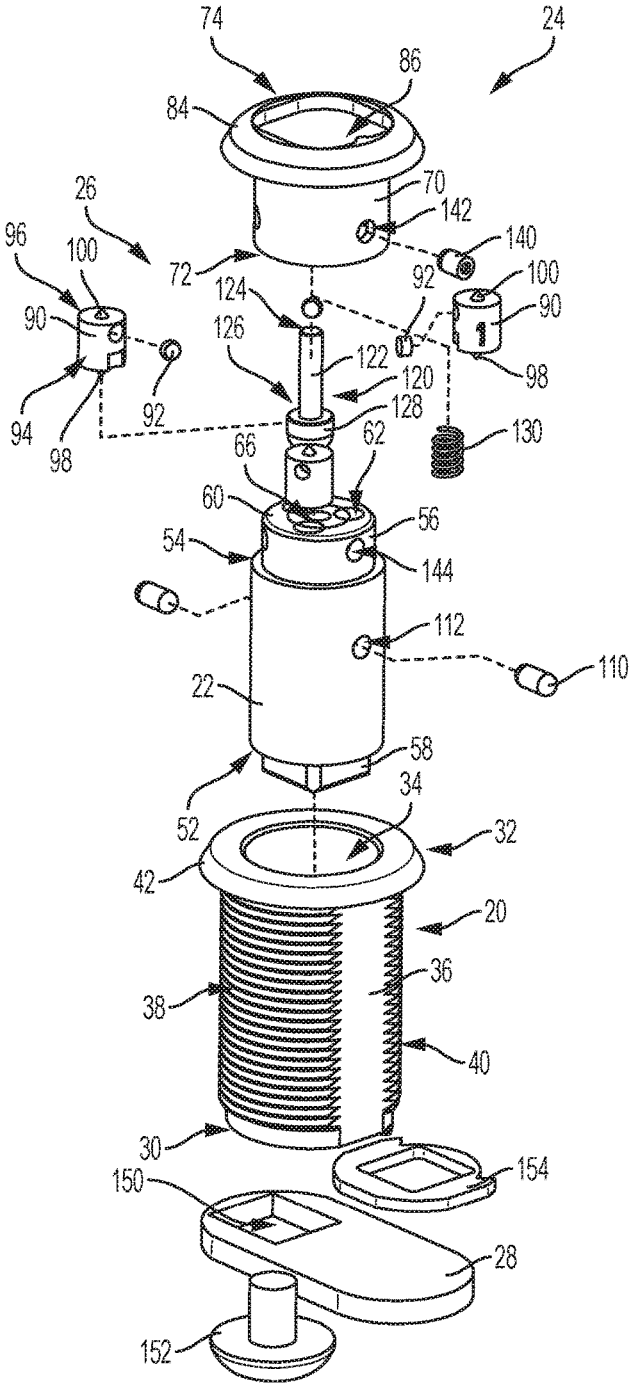
FIG. 2 is an exploded view of the magnetic cylinder lock of FIG. 1, the magnetic cylinder lock comprising at least a cylinder frame, a cylinder body, magnetic bodies, and a cylinder cap, in accordance with an embodiment.

FIG. 2 presents an exploded view of the magnetic lock device 12 which comprises at least a tubular cylinder frame 20, a cylinder body 22, a cylinder cap 24, three magnetic bodies 26, and a cam 28.

The tubular frame 20 extends along a longitudinal axis between a first end 30 and a second end 32 and defines a cylindrical internal cavity 34 which also extends between the first and second ends 30 and 32. The external longitudinal face 36 that extends between the first and second ends 30 and 32 comprises two threaded sections 38 and 40 spaced apart by two non-threaded sections. The tubular frame 20 further comprises a rim 42 that extends outwardly and radially from the second end 32. The tubular frame 20 is adapted to be inserted into a hole present in the element to be locked/unlocked, such as a door or a cabinet, until the rim 42 abuts the surface of the element to be locked/unlocked. The two planar sections located between the threaded sections 38 and 40 are used for adequately orienting the tubular frame 20 relative to the element to which it is to be secured. A nut is then screwed on the tubular frame 20 for securing the tubular frame 20 to the element. In one embodiment, the two planar sections may be omitted so that a single threaded section extends around the circumference of the tubular frame 20.

Figure 3:
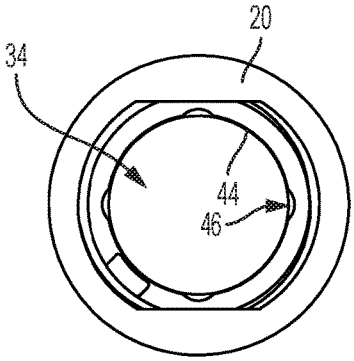
FIG. 3 is a top view of the cylinder frame of FIG. 2.

As illustrated in FIG. 3, the internal wall 44 of the internal cavity 34 of the tubular frame 20 is provided with four recesses 46 which are located at four different angular positions along the perimeter of the wall 44. In the illustrated embodiment, the recesses 46 are positioned at the following angular positions: 0, 90, 180, and 270 degrees. It should be understood that the illustrated angular positions for the recesses 46 are exemplary only and that other configurations are possible. Similarly and as described below, the number of recesses 46 may vary as long as the internal wall 44 comprises at least one recess 46 defining a locking position for the magnetic lock system 10.

The cylinder body 22 comprises a tubular section 50 extending between a first end 52 and a second end 54 along the longitudinal axis. A cylindrical section 56 extends outwardly and longitudinally from the second end 54 of the tubular section 50 and a square hollow section 58 extends outwardly and longitudinally from the first end 52 of the tubular section 50. The wall or face 60 of the cylindrical section 56 that is opposite to the second end 54 of the tubular section 50 comprises three conical recesses 62.

Figure 4:
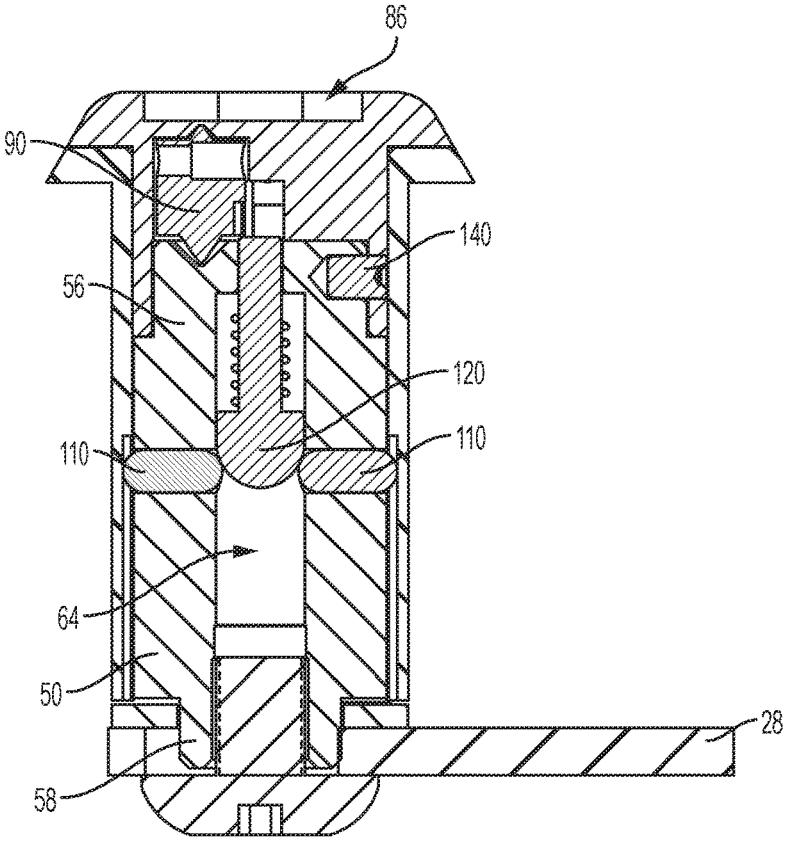
FIG. 4 is a cross-sectional view of the magnetic cylinder lock of FIG. 2 in a locked position, in accordance with an embodiment.

As illustrated in FIG. 4, the cylinder body 22 further defines a cylindrical cavity 64 that longitudinally extends through the tubular section 50 and the square section 58 and partially through the cylindrical section 56. The face 60 further comprises a hole 66 extending therethrough and emerging in the cavity 64. In the illustrated embodiment, the hole 66 is centered on the face 60 and the conical recesses 62 are positioned at different angular positions about the central hole 66.

It should be noted that in the illustrated embodiment the cylindrical section 56 has an external diameter that is less than that of the tubular section 50.

Figure 5:
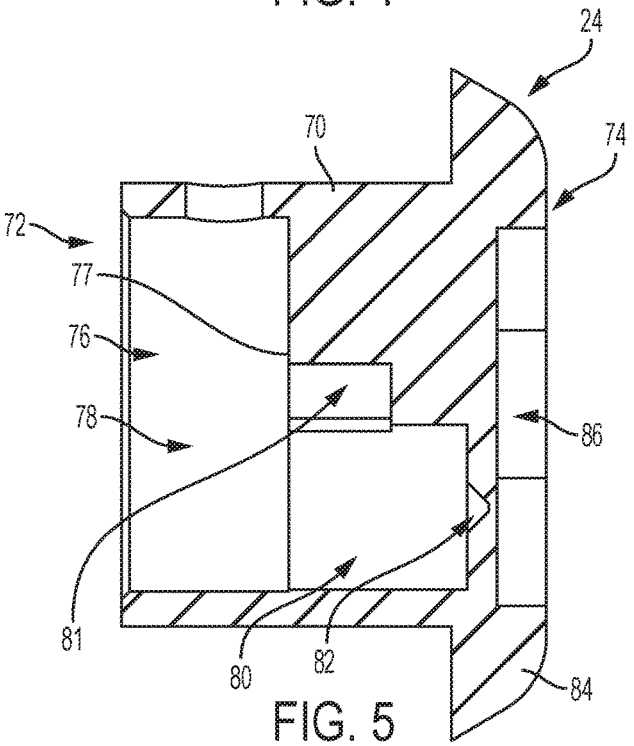
FIG. 5 is a cross-sectional view of the cylinder cap of FIG. 2, in accordance with an embodiment.

As illustrated in FIG. 5, the cylinder cap 24 comprises a cylinder section 70 that extends along the longitudinal axis between a first end 72 and a second end 74. The cylinder section 70 defines a cavity 76 that extends from the first end 72 towards the second end 74. The cavity 76 comprises a cylindrical cavity section 78 that extends from the first end 72 towards the second end 74 up to a wall 77, three cylindrical chamber sections 80 that extends from the cylindrical cavity section 78 towards the second end 74, a central recess section 81 centrally extending from the cylindrical cavity section 78 along a portion of the length of the cylindrical chamber sections 80, and three conical recesses 82 each extending from a respective cylindrical chamber section 80 towards the second end 74. The cylindrical cavity section 78 is sized and shaped to receive the cylindrical section 56 of the cylinder body 22 therein. In one embodiment, the diameter of the cylindrical section 56 substantially correspond to that of the cylindrical cavity section 78 so that the cylindrical section 56 be snuggingly received in the cylindrical cavity section 78. The three cylindrical chamber sections 80 are positioned about the central recess section 81 and they are connected with the central recess section 81 to form a single cavity.

The cylinder cap 24 further comprises a rim 84 that extends radially and outwardly from the second end 74 of the cylinder section 70. A key-receiving recess 86 also extends from the second end 74 of the cylinder cap 24 towards the first end 72. It should be noted that the key-receiving recess 86 is shaped and sized for receiving the magnetic key 14.

Figure 7:
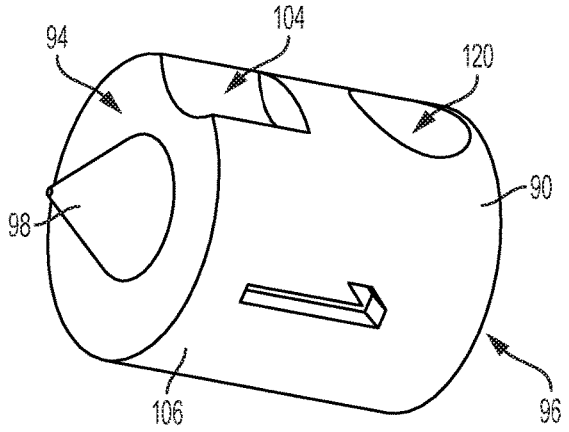
FIG. 7 is a perspective view of one of the magnetic bodies of FIG. 2, in accordance with an embodiment.
Figure 8:
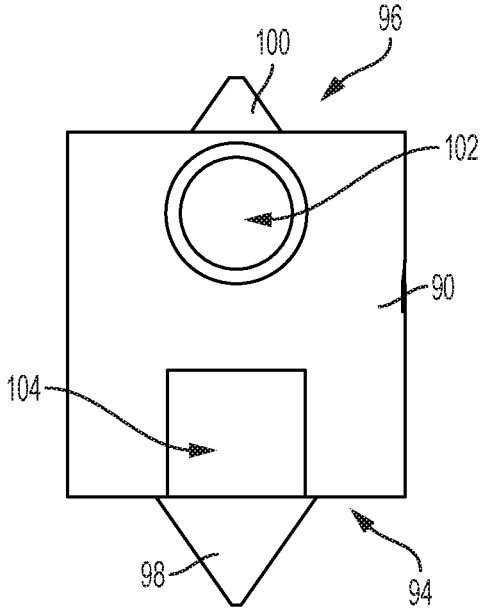
FIG. 8 is a front view of the magnetic body of FIG. 7.

Referring back to FIG. 2, the cylinder lock device 12 further comprises three magnetic bodies 26 which each include a respective cylindrical disk 90 and a respective magnet 92. Each cylindrical disk 90 extends along the longitudinal axis between a first end 94 and a second end 96 as illustrated in FIGS. 7 and 8. A first conical protrusion 98 extends outwardly from the first end 94 and a second conical protrusion 100 extends outwardly from the second end 96. The first conical protrusion 98 of each cylindrical disk 90 is shaped and sized to be received within a respective conical recess 62 of the tubular section 50. The second conical protrusion 100 of the each cylindrical disk 90 is shaped and sized to be received within a respective conical recess 82 of the cylinder cap 24. Furthermore, each cylindrical disk 90 is sized and shaped to be received in a respective cylindrical chamber section 80 of the cylinder cap 24.

Each cylindrical disk 90 is further provided with a magnet-receiving hole 102 sized and shaped to receive a respective magnet 92. In the illustrated embodiment, both the magnet 92 and the magnet-receiving hole 102 have a cylindrical shape. The person skilled in the art will understand that other shapes for the magnet 92 and the magnet-receiving hole 102 are possible as long as the magnet 92 may be received within the magnet-receiving hole 102. Each cylindrical disk 90 is further provided with a semi-cylindrical recess 104 that extends from the first end towards the second end 96 and from the longitudinal wall 106 of the cylindrical disk 90.

Referring back to FIG. 2, the cylinder lock device 12 further comprises two active pins 110. Each active pin 110 is made of a cylinder provided with rounded ends. The longitudinal wall of the tubular section 50 of the cylinder body 22 comprises two holes 112 extending therethrough and each hole 112 is adapted to receive a respective active pin 110. Each hole 112 is sized and shaped to slidably receive a respective active pin 110 therein. The position of the holes 112 along the length of the tubular section 50 is chosen so that the holes 112 may face a respective recess 46 on the internal wall 44 of the tubular frame 20 when the cylinder body 22 is inserted into the cavity 34 of the cylinder frame 20.

The cylinder lock device 12 also comprises a translation pin 120 that includes a cylindrical portion 122 extending along the longitudinal axis between a first end 124 and a second end 126, and a head section 128 protruding from the second end 126. The head section 128 has a hemi-spherical shape of which the diameter is greater than that of the cylindrical portion 122. It should be understood that the head section 128 may be provided with a shape other than a hemi-spherical shape. For example, the head section 122 may be provided with a conical shape, a pyramidal shape, or the like. Similarly, while the present description refers to a pin portion 122 having a cylindrical shape, it should be understood that the portion 122 may have another shape such as a square cross-sectional shape, a rectangular cross-sectional shape, etc.

The head section 128 is sized and shaped so as to be translationally received within the cavity 64 of the tubular section 50 while the end 124 of the translation pin 120 is sized and shaped to be translationally received within the hole 66 of the cylindrical section 56. In one embodiment, the curvature of the end 124 is substantially equal to the curvature of the semi-cylindrical recess 104.

In one embodiment, a spring 130 is also provided to be positioned about the cylindrical portion 122 of the translation pin 120.

When assembling the cylinder lock device 12, a magnet 92 is inserted into the magnet-receiving hole 102 of each cylindrical disk 90, thereby forming the magnetic bodies 26. It should be understood that adhesive may be used to fixedly secure the magnets 92 in their respective magnet-receiving hole 102. Then the magnetic bodies 26 are each inserted into a respective cylindrical chamber section 80 of the cylinder cap 24 so that the conical protrusion 100 be received into a respective recess 82 of the cylinder cap 24.

Then the cylindrical section 56 of the cylinder body 22 is inserted into the cylindrical cavity section 78 of the cylinder cap 24 so that the conical protrusion 98 of each magnetic body 26 be received into a respective conical recesses 62 of the cylindrical section 56. The cylinder cap 24 is then secured to the cylinder body 22 using a securing pin 140 which is inserted through a hole 142 present in the longitudinal wall of the cylinder section 70 and through a hole 144 present in the external wall of the cylindrical section 56. While the present description refers to the use of a securing pin 140 for securing together the cylinder cap 24 and the cylinder body 22, the person skilled in the art will understand that other securing means may be used. For example, a screw may be used. In another embodiment, the holes 142 and 144 may be omitted and an adhesive may be used to secure together the cylinder cap 24 and the cylinder body 22.

Once the cylindrical section 56 is inserted into the cylindrical cavity section 78, the magnetic bodies 26 may each rotate within their respective chamber section 80. Since the magnets 92 of the magnetic bodies 26 attract one another, the magnetic bodies 26 rotate within their respective chamber section 80 under the attraction force generated between the magnets 92. The magnetic bodies 26 are then positioned in an inactive position, as illustrated in FIG. 4. For at least one given magnetic body 26, the relative position between the recess 104 and the hole 102 is chosen so that the recess 104 does not face the center of the cylindrical cavity section 78 when the magnetic bodies are in the inactive position. As a result, the end face 94 of the given magnetic body 26 obstructs at least partially the hole 66 present in the face 60 of the cylindrical section 56 when the magnetic bodies 26 are in the inactive position.

Once the cylinder cap 24 and the cylinder body 22 are secured together, the spring 130 is positioned about the cylindrical portion 122 of the translation pin 120 and the translation pin 120 is inserted into the cavity 64 of the cylinder body 22 so that the end 124 of the translation pin 120 faces the hole 66 of the cylindrical section 56. The active pins 110 are inserted into their respective hole 112 so that they emerge within the cavity 64 of the cylinder body 22 and that the head section 128 of the translation pin 120 be located between the portion of the active pins emerging within the cavity 64 and the cylindrical section 56.

The assembly comprising the cylinder body 22 having the cylinder cap 24 secured thereto, having the active pins 110 inserted into their respective hole 112, and having the translation pin 120 inserted into the cavity 64 is inserted into the tubular frame 20 until the rim 84 of the cylinder cap 24 abuts against the rim 42 of the tubular frame 20. The assembly is then rotated until the holes 112 of the tubular section 50 each face a respective recess 46 present on the internal face of the tubular frame 20. Since it is positioned in compression, the spring 130 exerts a pressure force on the head section 128 of the translation pin 120 which in turn exerts a force on the active pins 110. As a result of the force exerted by the head section 128, the active pins 110 each translate within their respective hole 112 and their respective recess 46 until their rounded end abuts the internal wall 44 of the cylinder frame 20 within the recess 46. The tubular section 50, and therefore the assembly are then prevented from rotating within the cavity 34 of the cylinder frame 20.

The cam 28 is then secured to the square section 58 of the cylinder body 22. The cam 28 is provided with a square aperture 150 being sized and shaped to snuggingly receive the square section 58. The square section 58 is then inserted into the square aperture 150 of the cam 28 and a securing means such as bolt 152 is used to fixedly secure the cam 28 to the cylinder body 22 so that a rotation of the cylinder body 22 within the cylinder frame 20 triggers a rotation of the cam 28. The bolt 152 may be screwed within the cavity 64 of the cylinder body 22. It should be understood that any adequate method for fixedly securing the cam 28 to the cylinder body 22 may be used. For example, adhesive may be used for fixedly securing the cam 28 to the cylinder body 22. While the present description refers to a square shape for the section 56 and the aperture 150, it should be understood that other shapes may be envisioned as long as the section 56 fits into the aperture 150 and a rotation of the section 56 triggers a rotation of the cam 28. For example, the section 56 and the aperture 150 may each have a triangular shape.

In one embodiment, a stop plate 154 is inserted between the cam 28 and the cylindrical section 50. As known in the art, the stop plate 154 is adapted to limit the rotation of the cylinder body 22 to a desired angle such as 90 degrees or 180 degrees.

Figure 11:
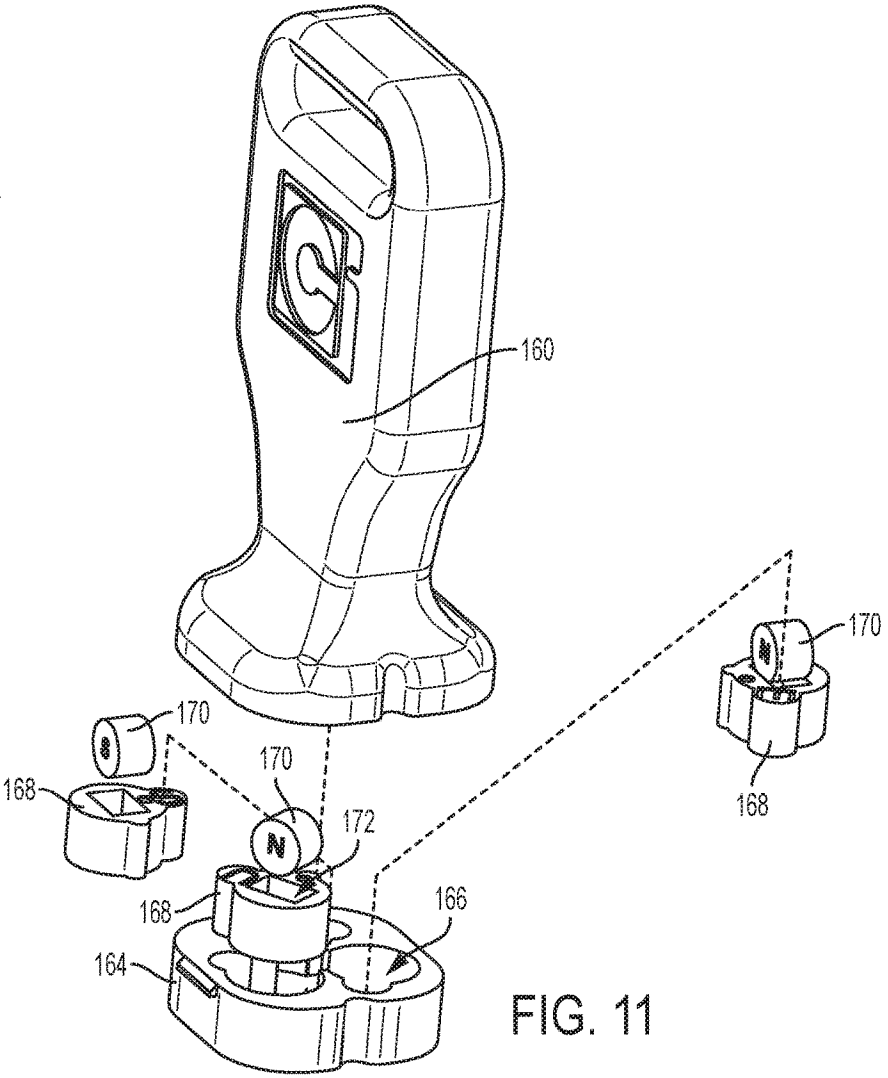
FIG. 11 is an exploded view of the magnetic key of FIG. 10.
Figure 10:
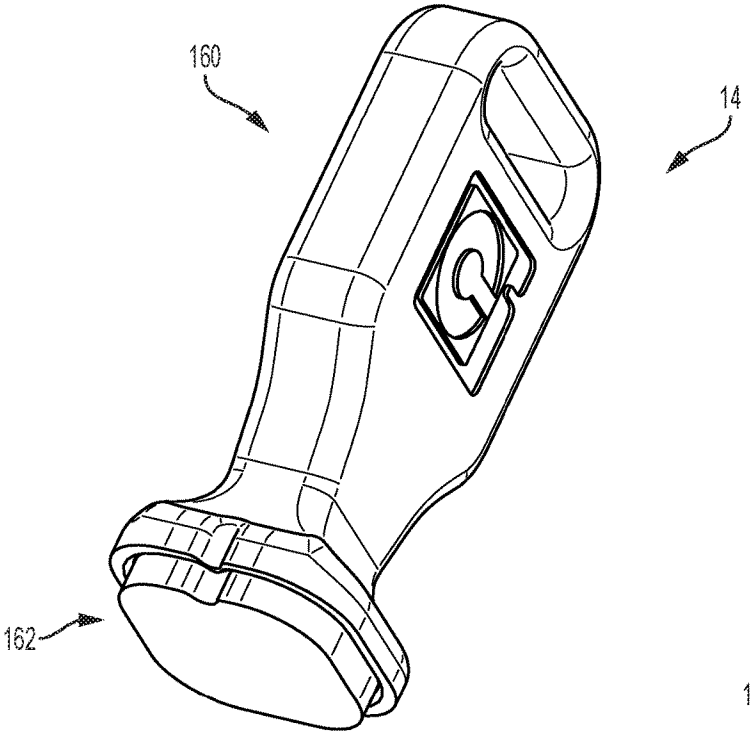
FIG. 10 is a perspective view of the magnetic key of FIG. 1, in accordance with an embodiment.
Figure 12:
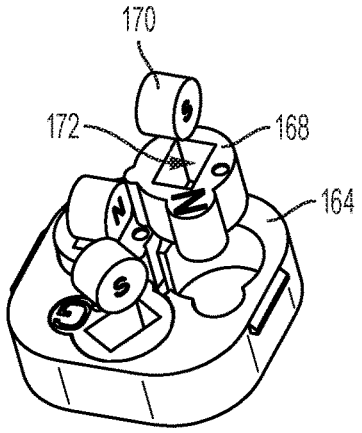
FIG. 12 illustrates the relative positioning of magnets within the magnetic key of FIG. 10.

As described above, the lock system 10 further comprises a magnetic key 14 which is illustrated in FIGS. 10-12.

Figure 13:
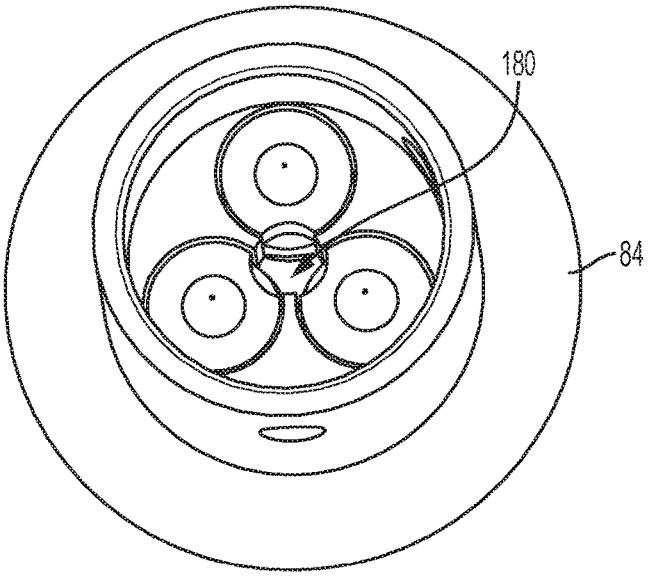
FIG. 13 illustrates the relative positioning between magnetic bodies of FIG. 2 when the magnetic cylinder lock is in an unlocked position, in accordance with an embodiment.

The magnetic key 14 comprises three key magnets each corresponding to a respective magnet 92 of a corresponding magnetic body 26. When the key 14 is positioned within the key-receiving recess 86, each key magnet attracts its corresponding magnet 92. The position of each key magnet within the key 14 is chosen as a function of the relative position between the hole 102 and the recess 104 of its respective magnetic body 26 so that, when the key 14 is received within the key-receiving recess 86, each key magnet attracts its respective magnet 92 and rotates its respective magnetic body 26 up to an active position. FIG. 13 illustrates the magnetic bodies 26 positioned in the active position when the magnetic key 14 is positioned in the key-receiving recess of the cylinder cap 24.

In one embodiment, the key 14 comprises a finger-receiving portion 160 which allows a user to hold the key 14, and a lock-abutting portion 162 adapted to be inserted into the key-receiving recess 86. In one embodiment, the lock-abutting 162 comprises a plate 164 insertable into a recess located (not shown) in the finger-receiving portion 160. The plate 164 comprises three insert-receiving recesses 166 each for receiving a respective insert plate 168. Each insert plate is provided with a magnet-receiving recess 172 for receiving a respective key magnet 170.

The position of the insert-receiving recesses 166 within the plate 164 and the position of the magnet-receiving recesses 172 within the insert-receiving recesses 166 are chosen so that each magnet key 170 attracts its respective magnet 92 and rotates its respective magnetic body 26 up to an active position.

In one embodiment, the magnetic key 14 and/or the cylinder cap 24 is adapted to adequately orient the key 14 so that each key magnet be adequately positioned relative to its corresponding magnetic body 26 when the key 14 is inserted into the key-receiving recess 86. For example, the key 14 and the cylinder cap 24 may each be provided with a respective reference mark and the magnetic key is inserted into the key-receiving recess so that the two reference marks face one another. In another example, the magnetic key may be provided with a recess or a notch and the cylinder cap 24 may be provided with a corresponding protrusion adapted to fit into the notch. In this case, the magnetic key 14 is positioned within the key-receiving recess 86 so that the protrusion of the cylinder cap 24 be inserted into the notch of the key 14 in order to adequately position the key magnet relative to their respective magnetic body 26. In a further example, the magnetic key 24 and the key-receiving recess 86 may be provided with a matching asymmetric shape such as a scalenus triangular shape in order to adequately position the key magnet relative to their respective magnetic body 26 when the magnetic key 14 is inserted into the key-receiving recess 86.

Figure 9:
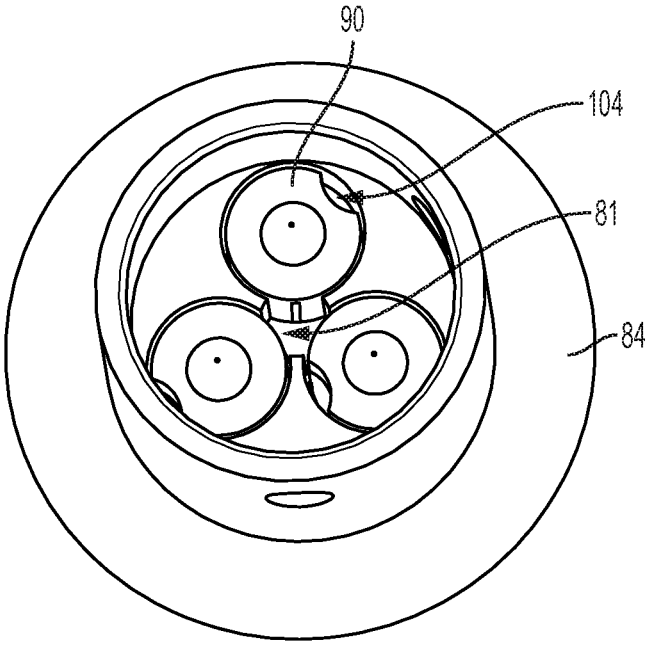
FIG. 9 illustrates the relative positioning between magnetic bodies of FIG. 2 when the magnetic cylinder lock is in a locked position.

Referring back to FIG. 4, the magnetic key 14 is away from the key-receiving recess 86 and the magnetic bodies 26 are in the inactive position. When the magnetic bodies 26 are in the inactive position, at least one magnetic body 26 obstructs the aperture 66 of the cylindrical section 56, thereby preventing the translation pin 120 from entering into the cylindrical cavity section 78, as illustrated in FIG. 9. The compression spring 130 exerts a compression force on the head section 128 of the translation pin 120 which in turn maintains the active pins 110 into their respective recess 46. The cam 28 is then prevented from any rotation and is in a first position, e.g. the locked position.

If a user tries to rotate the cylinder cap 24 without inserting the magnetic key 14 within the key-receiving recess 86, the magnetic bodies which obstruct the aperture 66 prevent the translation pin 120 from entering into the cylindrical cavity section 78. Since the translation pin 120 cannot translate into the cylindrical cavity section 78, the head section 128 of the translation pin 120 prevents any translation of active pins 110 towards the center of the cavity 64 and the active pins 110 remain positioned within their respective recess 46, thereby preventing any rotation of the cylinder body 22 within the cavity 34 of the cylinder frame 20.

Figure 6:
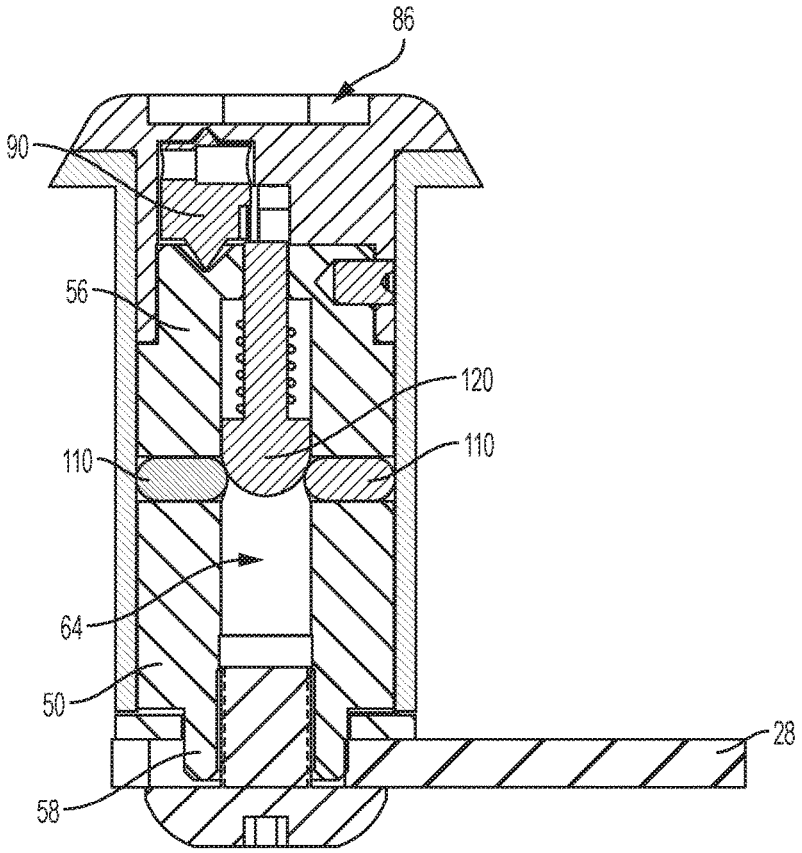
FIG. 6 is a cross-sectional view of the magnetic cylinder lock of FIG. 2 in an unlocked position, in accordance with an embodiment.

When the magnetic key 14 is inserted into the key-receiving recess 86, the key magnets each attract their respective magnet 92. The magnetic attraction force between the key magnets and their respective magnet 92 triggers a rotation of the respective magnetic bodies 26 and brings the magnetic bodies 26 in the active position. When the magnetic bodies 26 are positioned in the active position, the recesses 104 of the magnetic bodies 26 each face the central recess section 81 and form together with the central recess section 81 a pin-receiving cavity 180 sized and shaped to receive the end 120 of the translation pin 120, as illustrated in FIGS. 6 and 13.

A rotation of the magnetic key 14 triggers a rotation of the cylinder body 22 relative to the cylinder frame 20 since the cylinder body and the cylinder cap 24 are fixedly secured together. The rotation of the cylinder body 22 relative to the cylinder frame 20 creates a translation force exerted by each recess 46 on its respective active pin 110. As a result of the translation force, the active pins translate within their respective hole 112 towards the center of the cavity 64 and exert a force on the head section 128 of the translation pin 120. As a result of the force exerted on the head section 128 by the active pins 110, the spring 130 is compressed and the translation pin 120 translate towards the cylinder cap 24 so that its end 124 enters the cavity formed by the recesses 104. The cylinder body 22 may then freely rotate within the cylinder frame 20.

In one embodiment, the magnetic key 14 is rotated until each hole 112 faces another recess 46. When the holes 112 face their respective other recess 46 and the rotation of the magnetic key is stopped, the compression force exerted by the spring 130 on the head section 128 of the translation pin 120 pushes the active pins 110 into their respective other recess 46, thereby preventing a rotation of the cylinder body 22 within the cylinder frame 20. The cam 28 is then in a second position, e.g. the unlocked position.

The cam 28 may be brought back in the first position by rotating the magnetic key in the opposite direction until the holes 112 face the next recess 46 and the spring 130 pushes the active pins 110 in their respective next recess 46.

While the present description refers to a frame 20 having a tubular shape, it should be understood the frame 20 may have a shape other than tubular as long as it comprises the cylindrical cavity 34 in which the cylinder body 22 may rotate.

It should be understood that the number of active pins 110 and the number of holes 112 may vary as long as the magnetic lock device 12 comprises at least one active pin 110 and at least one hole 112.

Similarly the number of recess 46 may vary as long as the magnetic lock device 12 comprises at least one recess 46 for each active pin 110.

While the active pins 110 have rounded ends, it should be understood the shape of the ends of the active pins may vary. For example, the ends of the active pins 110 may be provided with a conical shape. In another embodiment, they may be flat.

While they have a hemi-spherical shape, it should be understood that the recesses 46 may be provided with any other adequate shape as long as the walls of the recesses 46 are inclined so as to allow the active pins to slide thereon.

While the present description refers to the protrusions 100 and 98 for the cylindrical bodies 90 and to corresponding recesses 62 and 82 to allow the rotation of the cylindrical bodies, it should be understood that any adequate rotatable connection may be used. For example, the cylindrical bodies may be rotatably secured to the cylinder body 22 and/or the cylinder cap 24 via a rotation shaft.

While the present description refers to recesses 104 having the shape of a portion of cylinder, it should be understood that the recesses 104 may be provided with any adequate shape as long as the cavity that they form in connection with the central recess 81 is shaped and sized to receive the translation pin 120.

The relative position between the recess 104 and the magnet 92 for each magnetic body 26 and/or the relative position between each key magnet and its respective magnetic body 26 may be varied to create multiple locking combinations. It should be understood that the position of the key magnets 170 within the magnetic key 14 is then chosen as a function of the position of the magnets 92. It should also be understood that the orientation of the magnets 92 and therefore that of the key magnets 170 may be varied to increase the number of possible locking combinations. It should further be understood that the key magnets 170 have a magnetic force that is adapted to attract their respective magnet 92 and rotate their respective magnetic body 26.

The person skilled in the art will understand that the number of magnetic bodies 26 may vary as long as the magnetic lock device 12 comprises at least one magnetic body 26. Increasing the number of magnetic body 26 allows increasing the number of possible locking combinations.

In an embodiment in which the magnetic lock device 12 comprises a single magnetic body 26, the cylinder cap 26 may comprise a reference magnet or a piece of ferrous material for attracting the magnet 92 when the magnetic key 14 is away from the cylinder cap 24 and rotating the magnetic body 26 in the inactive position.

While the cylindrical bodies 90 are rotatable in the illustrated embodiment, the person skilled in the art will understand that the cylindrical bodies 90 may be slidably secured within the cylinder cap 24. For example, they may slide along a radial direction to allow movement of the translation pin 120. In another example, they may slide along the longitudinal axis to allow movement of the translation pin 120.

In one embodiment, the cam 28 may be replaced by an electrical conductor element adapted to create an electrical contact between electrical terminals of an electric circuit in order to close the electrical circuit. In this case, the lock is a switch lock.

It should be understood that the recess 86 may be omitted. For example, the end 74 of the cylinder section 70 may have a knob shape comprising a substantially flat portion for receiving the magnetic key.

While the present description refers to the cylinder body 22 and the cylinder cap 24 as being separate pieces, the person skilled in the art would understand that the cylinder body 22 and the cylinder cap 24 may be integral together to form a single piece.

While in the above-illustrated embodiment, the magnetic lock device 12 operates in rotation, the person skilled in the art will understand that the magnetic lock device may operate in translation, i.e. the cylinder body translates with respect to the cylinder frame. In this case, the cylinder cap 24 is pushed or pulled instead of being rotated once the magnetic key 14 has been inserted into the key-receiving recess 86.

Figure 14:
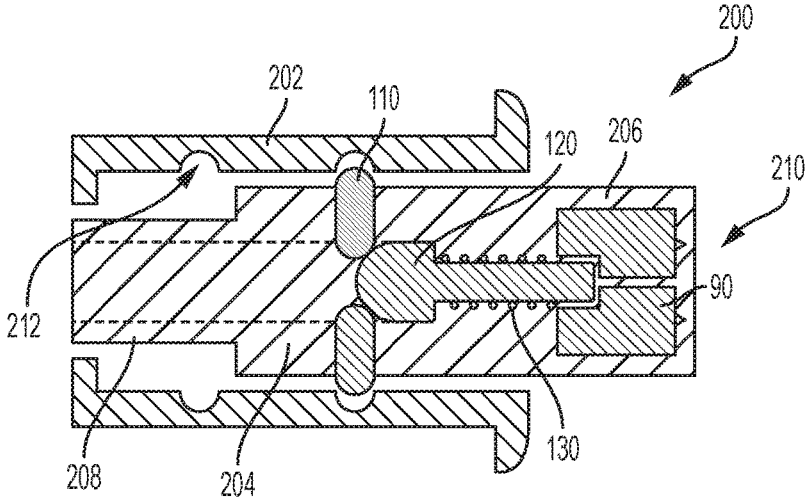
FIG. 14 illustrates a magnetic operating in translation when in a first locked position, in accordance with an embodiment.
Figure 15:
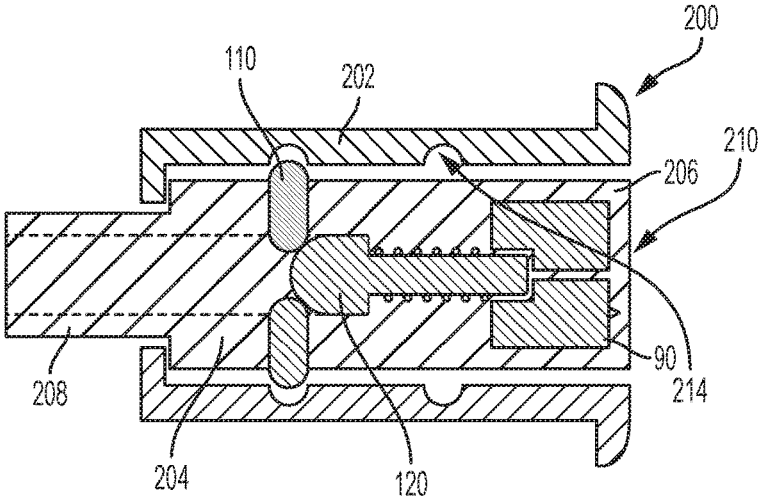
FIG. 15 illustrates the magnetic lock of FIG. 14 when in a second locked position.

FIG. 14 illustrates one embodiment of a lock device 200 that operates in translation. The lock device 200 comprises a frame 202, a lock body 204 which is slidably inserted into the frame 202, and a lock cap 206. The lock body 204 is similar to the cylinder body 22 and comprises holes for receiving active pins 110 and a cavity for receiving a translation pin 120. A locking bolt 208 is secured to the lock body 204 instead of the cam 28. The lock cap 206 is similar to the cylinder cap 24 and comprises a cavity for rotatably receive three cylindrical disk 90 which are rotatably secured to the lock body 204 and the lock cap 206. The lock cap 206 comprises a key receiving face 210 on which a magnetic key such as key 14 is abutted for unlocking the lock device 200. For each active pin 110, the internal face of the frame 202 comprises a first pin-receiving recess 212 and a second pin-receiving recess 214. The pin-receiving recesses 212 and 214 are located at the same angular position but at different positions along the length of the internal face of the frame 202.

The lock device 200 illustrated at FIG. 14 is in a first locked position. In this position, the translation pin 120 exerts a pressure force on the active pins 110 which abut in their respective pin-receiving recess 214, thereby preventing any translation of the lock body 204 within the frame 202.

By abutting the magnetic key 14 on the face 210 of the lock cap 206, the cylindrical bodies 90 rotate and create a cavity adapted to receive the end of the translation pin 120. When a translation force is exerted on the lock cap 206 while the magnetic key is in physical contact with or is adjacent to the face 210, the active pins 110 translate towards the center of the lock body 204 and exert a force of the translation pin 120. As a result of this force, the translation pin 120 translate toward the lock cap 206 and the end of the translation pin 120 enters the cavity created by the alignment of the cylindrical bodies 90, thereby allowing the active pins 110 to further move toward the center of the lock body 204 and the lock body 204 to move within the frame 202. During the movement of the lock body 204 within the frame 202, the spring 130 exerts a force on translation pin 120 which in turn exerts a force on the active pins 110 so that the active pins 110 are in physical contact with the internal wall of the frame 202 and slide thereon.

When they each face a respective first recess 212, the active pins 110 enter their respective first recess 212 due to the force exerted by the spring 130 and the translation of the lock body 204 is then stopped. The lock device 200 is then in a second locked position. The translation of the lock body 204 from the first locked position to the second locked position allows moving the locking bolt from a first position to a second position. The locking bolt may be used as a switch for closing an electrical circuit for example.

It should be understood that the recesses 212 may be omitted. Similarly, one of the recesses 214 and one of the active pins 110 may be omitted It should be understood that the above described cylinder lock device may be used as an actuator for different types of locking devices such as a cam lock, a door lock, a gate, a safe cabinet, a locker, or the like.

In one embodiment, an aim of the present cylinder lock system is to solve the double-layered protection system which requires carrying more keys, and furthermore to provide a solution that eliminates direct contact with the locking mechanism, such that a thief may not feel or listen his way around the locking pins, allowing him/her to achieve the unlocking of the cylinder.

Another object of the present cylinder lock system is to make picking of the lock extremely difficult even for an expert picker, and resistant to all existing picking methods.

Another goal is to provide a cylinder lock system that can be applied to common locks of the known type by making the new cylinder of a standard size, while maintaining enough locking combinations for each different application.

In one embodiment, the present cylinder lock system aims to provide a solution that is structurally simple and has relatively low manufacturing costs in order to make it affordable to end-users.

The embodiments of the invention described above are intended to be exemplary only. The scope of the invention is therefore intended to be limited solely by the scope of the appended claims.

The invention claimed is:

1. A lock device comprising:

a lock frame extending along a longitudinal axis, defining a cavity, and having at least one frame recess on an internal wall thereof;

a lock body having a longitudinal wall extending along the longitudinal axis and a key-receiving face, the lock body defining a chamber and the longitudinal wall comprising at least one aperture therethrough, each one of the at least one aperture facing a respective one of the at least one frame recess, the lock body being moveable within the cavity of the lock frame between a first body position and an second body position;

a translation pin movably inserted within the chamber;

at least one active pin each positioned within a respective aperture of the lock body and movable between an insertion position in which the active pin abuts against a respective frame recess of the lock frame and prevent the lock body from moving within the cavity, and a retracted position in which the active pin is away from the frame recess and allows the lock body to move within the cavity;

at least one magnetic body each positioned within the chamber of the lock body and movable between a first pin position in which the translation pin is prevented from moving and a second pin position in which the translation pin is allowed to move; and an actuator body secured to the lock body to move from a locked position when the lock body is in the first body position and an unlocked position when the lock body is in the second body position, wherein upon positioning a magnetic key adjacent to the key-receiving face, the at least one magnetic body moves from the first pin position to the second pin position to allow the translation pin to move within the chamber and upon rotating the magnetic key, the active pins move from the insertion position to the retracted position, thereby allowing the lock body to move from the first body position to the second body position and the actuator body to move from the locked position to the unlocked position.

2. The lock device of claim 1, wherein the lock body is slidable within the lock frame.

3. The lock device of claim 1, wherein the lock body is rotatable within the lock frame.

4. The lock device of claim 3, wherein the lock frame and the lock body each have a cylindrical shape.

5. The lock device of claim 3, wherein the at least one frame recess each have a semi-cylindrical shape.

6. The lock device of claim 3, wherein the at least one magnetic body are each rotatably secured to the lock body, the first and second body positions corresponding to a first angular position and a second angular position, respectively.

7. The lock device of claim 6, wherein the at least one magnetic body each comprise a non-magnetic cylinder rotatably secured to the lock body and the lock frame.

8. The lock device of claim 7, wherein the at least one magnetic body comprises a magnet-receiving recess and a magnet secured therein.

9. The lock device of claim 7, wherein the non-magnetic cylinder comprises two conical ends, a first one of the two conical ends being received in a first conical recess within the lock frame and a second one of the two conical ends being received in a second conical recess within the lock body for rotatably securing the non-magnetic cylinder to the lock body and the lock frame.

10. The lock device of claim 7, wherein the non-magnetic cylinder comprises a recess on an external face for receiving at least a section of the translation pin thereon.

11. The lock device of claim 3, further comprising a thread extending circumferentially along a section of the lock frame.

12. The lock device of claim 3, wherein the at least one frame recess comprise two frame recesses each corresponding to a respective one of the locked and unlocked positions.

13. The lock device of claim 1, wherein the at least one active pin are each provided with rounded ends.

14. The lock device of claim 1, wherein the actuator body comprises a cam.

15. A lock system comprising the lock device of claim 1 and a magnetic key.

16. The lock system of claim 15, wherein the magnetic key comprises at least one key magnet each positioned within the magnetic key so as to substantially face a respective one of the at least one magnetic body when the magnetic key is positioned adjacent to the key-receiving face.

17. The lock system of claim 15, wherein the magnetic key and the key-receiving face of the lock body are configured so that a motion of the magnetic key triggers a motion of the lock body within the lock frame.

* * * * *